United States Patent [19]

Karayannis

[11] 4,088,076

[45] May 9, 1978

[54] SPINNING PROJECTILE EQUIPPED WITH AN ELECTROMAGNETIC IGNITION CURRENT GENERATOR

[75] Inventor: Panayotis Karayannis, Zurich, Switzerland

[73] Assignee: Werkzeugmaschinenfabrik Oerlikon Bührle AG, Zurich, Switzerland

[21] Appl. No.: 664,923

[22] Filed: Mar. 8, 1976

[30] Foreign Application Priority Data

Mar. 14, 1975 Switzerland ..... 3243/75

[51] Int. Cl.[2] ..... F42B 13/02; F42C 11/04; F42C 15/04; F42C 15/40

[52] U.S. Cl. ..... 102/70.2 G; 310/67 R

[58] Field of Search ..... 102/70.2 G, 70.2 GA; 310/67 R

[56] References Cited

U.S. PATENT DOCUMENTS

| | | | |
|---|---|---|---|
| 2,511,872 | 6/1950 | Parker | 102/70.2 G |
| 2,687,482 | 8/1954 | Harmon et al. | 102/70.2 G |
| 3,826,193 | 7/1974 | Rognmo et al. | 102/70.2 G |
| 3,994,228 | 11/1976 | Hurlimann | 102/70.2 G |

FOREIGN PATENT DOCUMENTS

| | | | |
|---|---|---|---|
| 2,520,202 | 5/1975 | Germany | 102/70.2 G |

*Primary Examiner*—Samuel W. Engle
*Assistant Examiner*—Thomas H. Webb
*Attorney, Agent, or Firm*—Werner W. Kleeman

[57] ABSTRACT

A spinning projectile containing an electromagnetic ignition current generator, comprising a fuze housing with an inner generator component fixed at the housing and possessing an armature coil and an outer generator component provided with a field magnet. A bearing arrangement having two bearing bodies is housed in a recess of the fuze housing, one of the bearing bodies being arranged at the fuze housing and the other forming part of the outer generator component. Both of the bearing bodies are substantially ring-shaped and possess essentially the diameter of the field magnet and form a bearing means for centering the field magnet. The fuze housing possesses a wall portion which bounds the inside of the recess which is constructed as a circumferential groove.

8 Claims, 3 Drawing Figures

SPINNING PROJECTILE EQUIPPED WITH AN ELECTROMAGNETIC IGNITION CURRENT GENERATOR

BACKGROUND OF THE INVENTION

The present invention relates to a new and improved construction of spinning projectile containing an electromagnetic ignition or firing current generator.

Generally speaking, the spinning projectile containing the electromagnetic ignition current generator of this development is of the type comprising a fuze housing, an inner generator component fixed at the housing and containing an armature coil or winding and an outer generator component provided with a field magnet. Further, a bearing having two bearing bodies is arranged in a recess of the fuze housing, one of the bearing bodies being arranged at the fuze housing and the other forming part of the outer generator component.

According to a state-of-the-art spinning projectile equipped with an electromagnetic ignition current generator of this type the field magnet is arrnged in a blindhole bore of the fuze housing in such a manner that it bears through the agency of a plate-shaped holder body forming one bearing body upon the base of the blindhole bore which is equipped with a sliding bearing surface forming the other bearing body. The bearing surface possesses a much smaller diameter than the field magnet. Upon passage of the projectile through the barrel of the weapon there is exerted on the one hand, upon the field magnet an axial inertia force and, on the other hand, a centrifugal force. The centrifugal force is present due to the fact that the projectile axis, owing to the play which is present between the part of the projectile body located in front of the guide band and the inner wall of the barrel, encloses a small angle with regard to the axis of the bore of the weapon barrel, and thus the center of gravity of the magnet is not located at the rotational axis of the projectile. The resultant force or resultant of the inertia force and the centrifugal force strives to tilt the field magnet about the edge of the bearing surface. This tilting moment must be counteracted by support surfaces at the fuze housing at which bears the front portion of the magnet. In this regard it is disadvantageous that there is applied to the magnet, apart from at the bearing surface, still at a further location —at the support surfaces— sliding friction forces which exert a driving action in the direction of rotation, so that there is reduced the difference in the rotational speed between the armature coil rotating with the fuze housing and the field magnet, and which rotational speed differential is decisive for the magnitude of the generated voltage.

A further drawback of the heretofore known generator resides in the fact that the space occupied by the plate-shaped holder body is then not available for other components of the fuze.

Further, the housing wall bounding the blindhole bore must possess a certain thickness for strength considerations since it carries the entire inner generator component with the armature coil. Hence, the maximum diameter of the field magnet which is decisive for the attainable mass moment of inertia and the attainable rotational speed differential, is limited by the inner wall of the blindhole bore.

SUMMARY OF THE INVENTION

Thus, with the foregoing in mind, it is a primary object of the present invention to provide an improved construction of spinning projectile containing an electromagnetic ignition current generator which is not associated with the aforementioned drawbacks and limitations of the prior art.

Another and more specific object of the present invention aims at avoiding the aforementioned drawbacks and providing a spinning projectile with an electromagnetic ignition current generator wherein there prevails a great rotational speed differential between the armature coil and the field magnet, and furthermore, there is eliminated the tilting moment, and there is rendered possible a space-saving arrangement.

Now in order to implement these and still further objects of the invention, which will become more readily apparent as the description proceeds, the invention contemplates that both of the bearing bodies are substantially ring-shaped and essentially possess the diameter of the field magnet and form a centering bearing or bearing means for the field magnet. Further, the fuze housing possesses a wall portion which limits at the inside the recess or recess means constructed as a peripheral or circumferential groove.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
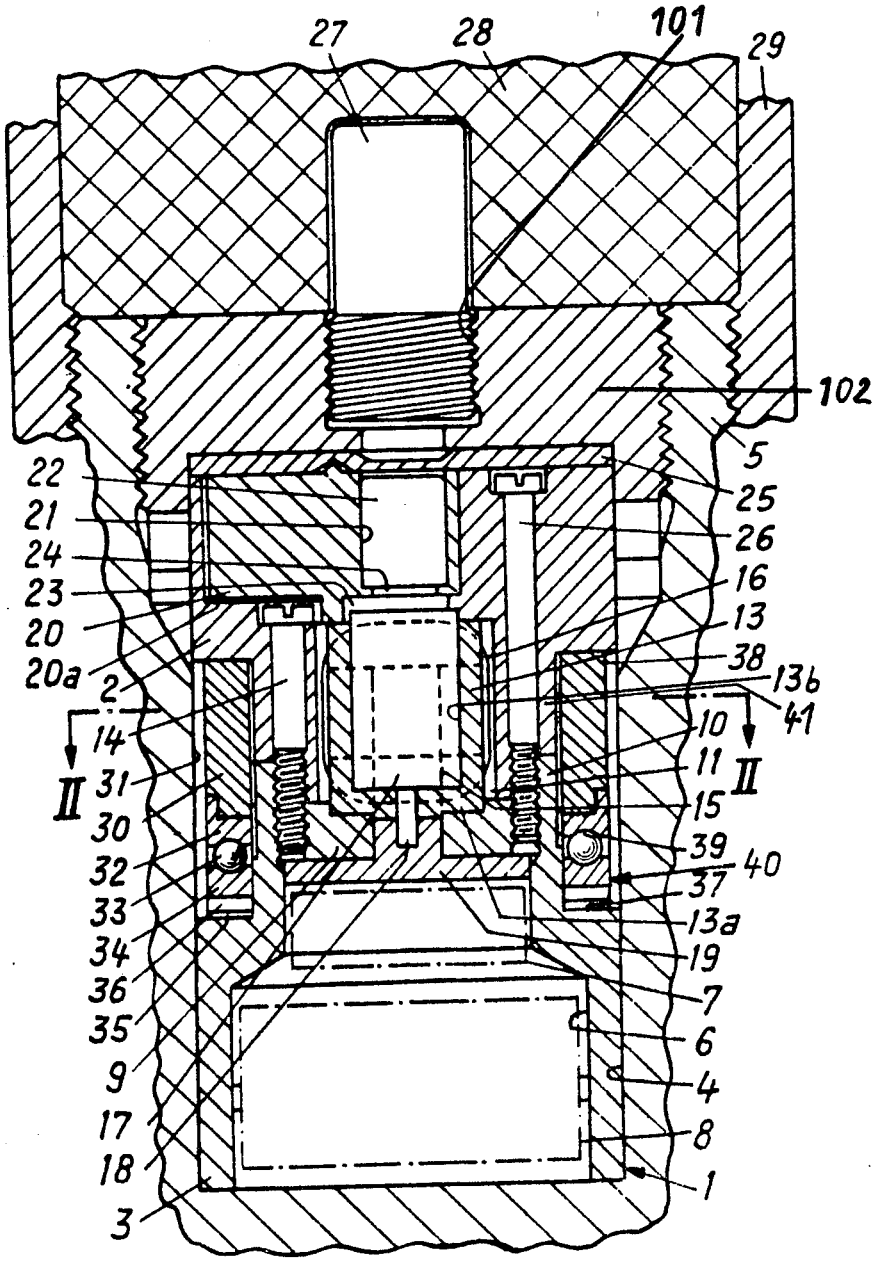
FIG. 1 is a longitudinal sectional view through a fuze in its transport position.

Describing now the drawings, it is to be understood that to simplify the showing of the drawings only enough of the structure of the spinning projectile has been shown as needed to enable those skilled in the art to readily understand the underlying concepts of the present invention. According to the showing of FIG. 1, the fuze illustrated therein will be seen to comprise a fuze housing 1 composed of a front housing portion 2 and a rear housing portion 3 which are threadably connected with one another by means of the threaded bolts or screws 14, 26 or the like. The fuze is arranged in a blindhole bore 4 in a tail or rear portion 5 of the projectile and bears at the base or floor of such blindhole bore. This blindhole bore 4 is concentrically arranged with respect to the lengthwise axis of the projectile. Arranged in an axial bore 6 of the rear housing portion 3 are two conventional fuze elements indicated by broken lines in the drawing, to wit, a current storage element 7 and electronic control means 8. The housing part or portion 3 possesses a cover 9 having a forwardly protruding cylindrical projection or extension 10 in which there is centered an axial wall portion 41 of the front housing portion or part 2. The front housing portion 2 possesses a groove 11 in the central plane of which there is located the fuze axis. In the groove 11 there is arranged a double-pole armature 12, as best seen by referring to FIG. 2, possessing a hollow cylindrical central armature portion 13 having a floor or base 13*a* which bears upon a recess in the housing cover 9, this recess being concentric to the fuze axis. The front housing portion 2 bears under the pressure of the threaded bolts or screws 14, 26 at an end surface of the armature portion 13, whereby the armature 12 is positively connected with the fuze housing 1. Two arms 15 extending outwardly from the central armature portion 13 carry a respective pole shoe 15*a* which bears upon the extension or projection 10 of the rear housing portion 3. Arranged upon the arms 15 are two windings or coils 16.

In a bore 13*b* in the armature portion 13 there is arranged a firing element 17 which is part of a fuze or ignition chain of the fuze. The firing element 17, for instance a detonator cap, contained in a jacket or shell embodies a not particularly further illustrated electronically ignitable, flame-generating firing means. A contact pin 18 of the firing element 17 protrudes through a bore in the floor or base 13*a* of the armature portion 13 into a plug portion 19 which is arranged in the bore 6 of the rear housing portion 3 and engages into a bore of the housing cover 9. The plug 19 is connected in any suitable and therefore not particularly illustrated manner with the current storage device 7, which may be for instance typically constituted by a capacitor.

The front end surface of the front housing portion 2 possesses a recess 20*a* in which there is rotatably mounted a rotor 20, the axis of the rotor 20 being essentially parallel to the projectile axis. The rotor 20 possesses an eccentric bore 21 in which there is arranged a detonator 22 forming part of the fuze or chain ignition. In the so-called armed or live position of the rotor 20 the axis of the bore 21 coincides with the fuze axis. The charge of the detonator 22 can be initiated by the flame action of the firing element 17. The groove 11 is in spatial communication via the bores 23, 24 in the housing 1 and in the rotor 20 with the bore 21 containing the detonator 22.

A cover 25 closes the fuze housing 1 towards the front. The fuze is fixedly held by means of a threaded disk or plate 102 in the projectile rear or tail portion 5, and such plate 102 is inserted into a part of the bore 4 of the projectile rear portion 5 provided with threading. A capsule or detonator 27 containing a reinforcement charge, and which is concentric to the fuze axis, forms the last element of the fuze or ignition chain of the fuze. The capsule 27 is secured in a bore 101 of the threaded disk 102 and protrudes forwardly into an explosive charge 28 which is arranged in a projectile body portion 29 threaded with the rear part or tail portion 5.

Figure 2:
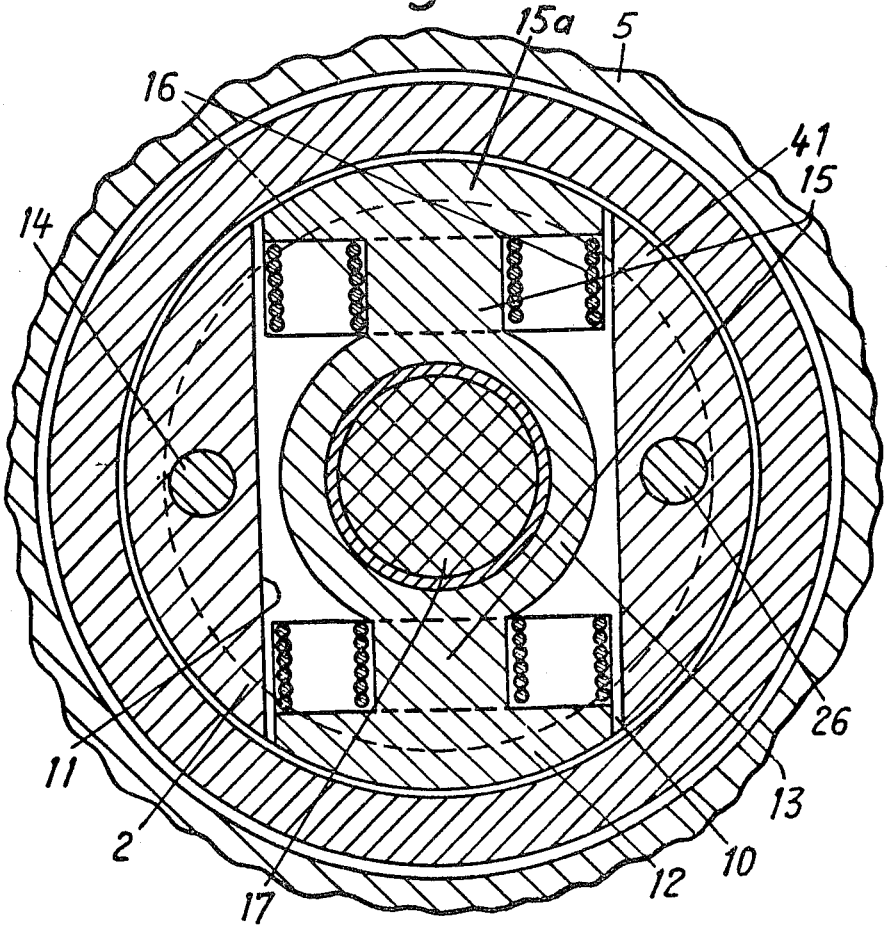
FIG. 2 is a cross-sectional view taken substantially along the line II—II of FIG. 1.
Figure 3:
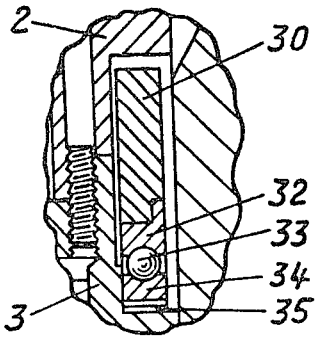
FIG. 3 is a fragmentary detail illustration corresponding to the showing of FIG. 1, of the fuze after firing.

A substantially ring-shaped double-pole, transversely magnetized field magnet 30 is arranged in a ring-shaped or annular recess 31 of the fuze housing 1, this recess 31 being formed as a circumferential or peripheral groove. Moreover, the inside of the recess 31 is bounded by the wall portions 10, 41 and both of the pole shoes 15*a*. The magnet 30 is fixedly connected with a front bearing body or race 32 of a longitudinal or axial ball bearing 40 and bears via the balls 33 upon a rear bearing body or race 34. The balls 33 are not separated from one another by a cage, so that to realize the required load bearing capability of the bearing there can be arranged an appropriately large number of balls. The support surface, by means of which the field magnet 30 and the front bearing body 32 fixedly connected therewith, bear upon the balls 33, is formed by an annular or ring-shaped groove 39 accommodated to the diameter of the balls. A similar ring-shaped groove is also provided in the rear bearing body or race 34. Such bears against forwardly directed protruding or bulging portions 36 of a flexible or deformable element such as ring 35 and which bulging portions are arranged at a uniform angular spacing from one another. The ring 35 is supported upon a rear flank or surface 37 of the ring-shaped groove or recess 31 and is directed perpendicular to the fuze axis. In FIG. 1 the magnet 30 has been shown in its transport position where it presses with its end surface, under the pressure of the pre-biased projections or bulging portions 36 of the ring 35, against a forward flank or surface 38 of the ring-shaped groove 31. In FIG. 3 there is illustrated the position of the field magnet 30 after the firing of the projectile, when the projections or bulging portions have been compressed together.

Having now had the benefit of the foregoing description of the spinning projectile equipped with an electromagnetic ignition current generator as contemplated by the invention its mode of operation will be considered and is as follows: By virtue of the fact that the field magnet 30 is pressed in the transport position against the front flank or surface 38 of the recess 31, there is prevented that prior to firing of the projectile the magnet 30 will rotate relative to the projectile. Upon the occurrence of the acceleration of the projections during firing the projection or bowed portions 36 of the ring 35 are compressed together under the action of the inertia force applied at the magnet 30. Consequently, as best seen by referring to FIG. 3, the magnet 30 is freed or released so that it does not have imparted to it any rotational drive from the fuze housing 1 which now rotates with the projectile. The inner and outer jacket surfaces of the magnet 30 and the bearing race 32 are equally free in that they exhibit a spacing both from the wall of the bore 4 as well as also from the inside of the recess 31. Due to mounting of the balls 33 in the peripheral or circumferential groove 39, the magnet 30, during firing of the projectile, automatically assumes a stable equilibrium position under the action of the inertia force applied thereat, and in which position it is centered at the rear bearing race 34 and retains such position during passage through the weapon barrel. In this position the magnet 30 neither contacts the rear portion 5 nor the fuze housing 1. Due to its arrangement in the recess 31 of the fuze housing 1, in other words at the largest possible diameter, the magnet 30 possesses a large mass moment of inertia. Owing to this large moment of inertia of the magnet 30 and its low friction mounting, during the acceleration phase of the projectile in the weapon barrel there occurs a large relative rotational speed between such magnet 30 and the armature coils or windings 16. The housing wall carrying the inner generator component with the armature 12 and armature coils 16 forms the inside of the recess 31 so that the dimensions thereof do not influence the diameter of the field magnet.

During passage of the projectile through the weapon barrel a centrifugal force is applied to the magnet 30. The line of action of the resultant of this centrifugal force and the inertia force simultaneously applied to the magnet 30 intersects a plane, directed perpendicular to the fuze axis containing the support surface of the magnet 30 and the edges of the circumferential groove 39, at a location between the support surface and the fuze axis. This also is the case when the axial acceleration of the projectile and therefore the inertia force applied at the magnet 30 is still only relatively small. The advantage which is realized from the large diameter of the support surface of the magnet 30 and of the circumferential groove 39 resides in the fact that the centrifugal force cannot bring about any tilting of the magnet 30 at the edge of its support surface.

Instead of using ball bearing 40 it would also be possible to use a sliding or friction bearing provided with guides holding the magnet 30 in radial direction.

While there are shown and described present preferred embodiments of the invention, it is to be distinctly understood that the invention is not limited thereto, but may be otherwise variously embodied and practices within the scope of the following claims.

Accordingly, what is claimed is:

1. A spinning projectile for firing from a weapon barrel and of the type equipped with an electromagnetic ignition current generator, comprising a rotatable fuze housing, an inner generator component fixedly arranged at said rotatable fuze housing for rotation therewith while the spinning projectile is in the barrel of the weapon firing of such spinning projectile, an armature coil provided for the inner generator component, an outer generator component provided with a field magnet, said fuze housing having a recess defining a peripheral groove, bearing means incorporating two bearing bodies housed in the recess of the fuze housing, one of the bearing bodies being arranged at the fuze housing and the other bearing body forming part of the outer generator component, both of the bearing bodies having a substantially ring-shaped configuration and further having essentially the diameter of said field magnet and form a bearing means for centering the field magnet, and the fuze housing having a wall portion bounding at its inside the peripheral groove formed by the recess.

2. The spinning projectile as defined in claim 1, wherein both bearing bodies are formed by races of an axial ball bearing and are centered via balls.

3. The spinning projectile as defined in claim 1, wherein the recess is partially bounded by a rear flank, a compressible element deformable in its axial direction, one of the bearing bodies being supported via the flexible element at the rear flank of the recess.

4. The spinning projectile as defined in claim 3, wherein the compressible element comprises a ring provided with pre-biased bulging portions, the recess being further bounded by a front flank, the ring pressing the field magnet against the front flank of the recess for preventing rotation of the field magnet relative to the fuze housing in a transport position for the projectile, said bulging portions being compressible together after firing of the projectile due to the inertia of the field magnet.

5. The spinning projectile as defined in claim 1, wherein the recess is radially open towards the outside.

6. The spinning projectile as defined in claim 1, wherein the wall portion defines support means for the inner generator component.

7. The spinning projectile as defined in claim 1, wherein the armature coil has a bore, and a firing element consituting part of an ignition chain is arranged in said bore of the armature coil.

8. The spinning projectile as defined in claim 1, wherein said bearing means defines a single bearing structure for centering the field magnet.

* * * * *